United States Patent [19]

Tessel

[11] Patent Number: 4,828,269

[45] Date of Patent: May 9, 1989

[54] HIT-SCORING SHOOTING TARGET

[75] Inventor: Mordechai Tessel, Elkanah, Israel

[73] Assignee: Hadass Firing Range Systems Limited, Tel-Aviv, Israel

[21] Appl. No.: 159,493

[22] Filed: Feb. 11, 1988

Related U.S. Application Data

[63] Continuation of Ser. No. 886,268, Jul. 16, 1986, abandoned.

[30] Foreign Application Priority Data

Jul. 19, 1985 [IL] Israel ..... 75848

[51] Int. Cl.[4] ..... F41J 5/04

[52] U.S. Cl. ..... 273/373

[58] Field of Search ..... 273/373

[56] References Cited

U.S. PATENT DOCUMENTS

| | | | |
|---|---|---|---|
| 2,576,960 | 12/1951 | McAvoy | 273/373 |
| 2,749,125 | 6/1956 | Ream | 273/373 |
| 3,004,735 | 10/1961 | Kinard | 273/373 X |
| 3,004,763 | 10/1961 | Knapp | 273/373 |
| 3,580,579 | 5/1971 | Scharz | 273/373 |

FOREIGN PATENT DOCUMENTS

| | | | |
|---|---|---|---|
| 2092276 | 6/1982 | United Kingdom | 273/373 |

*Primary Examiner*—Anton O. Oechsle
*Attorney, Agent, or Firm*—Browdy & Neimark

[57] ABSTRACT

A hit-scoring target for shooting practice having several mutually bonded layers, a first layer at least the outside surface of which is electrically conductive, a second, electrically nonconductive, at least semi-rigid layer imparting mechanical strength to the first layer and made of a material tolerant of the heat of a freshly fired projectile, a third, electrically nonconductive layer made of an elastically resilient material, a fourth layer of which at least the surface contacting the third layer is electrically conductive, and a fifth layer serving as a backing and imparting relative rigidity to said target. The distance between the electrically conductive surfaces of the first and the fourth layer is smaller than the length of the shortest projectile to be fired at the target, whereby a projectile hitting, penetrating and passing through the target causes a transient electrical low-resistance connection to be established between the electrically conductive surfaces.

16 Claims, 1 Drawing Sheet

HIT-SCORING SHOOTING TARGET

Figure 1:
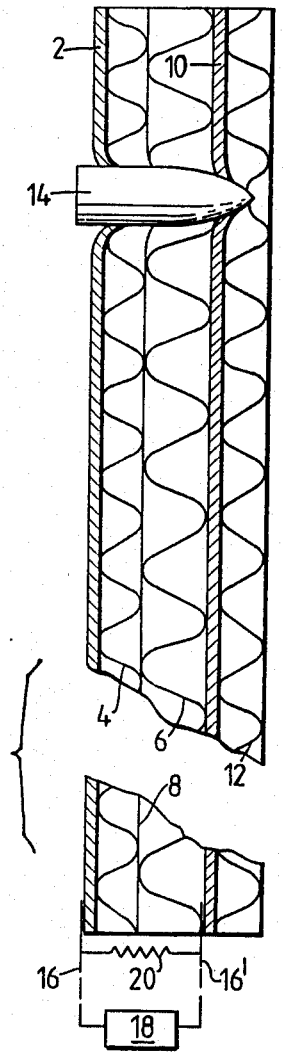

This application is a continuation, of application Ser. No. 886,268, filed July 16, 1986, now abandoned.

The present invention relates to a hit-scoring multilayer target or shooting practice.

Hit-scoring targets in use today work mainly on the shooting principle: a metal-jacketed projectile hitting and penetrating the target, temporarily connects two conductive layers, thereby shorting an electric circuit and producing a signal that actuates a counter which records a hit. When the projectile has passed through the target, the connection is again broken and the counting circuit reset.

While this principle is indeed very simple, its application has encountered many difficulties as is borne out by the fact that none of the very many attempts made towards a reliable as well as inexpepensive hit-scoring target have produced satisfactory results.

The main problem was seen to be the difficulty of preventing the establishing, after a relatively small number of hits, of a permanent, rather than transient, short, which made the target obviously unserviceable and thus rendered its cost per projectile fired at it forbiddingly high. Measures taken to deal with this problem were only very partially successful and as they called for a more complex circuitry and/or the use of much more expensive materials, they were largely self-defeating. Such measures included the burning away, via a special electrical circuit, of electrode elements that have produced such a permanent short (U.S. Pat. No. 3,113,110—Schulman) or the use of such relatively expensive material as polymer-resin coated fiberglass webs, foamed polypropylene, resin-coated, brittle calandered, woven aluminium wire screen, and the like (U.S. Pat. No. 4,240,640—LaMura). Most of the known hit-scoring targets are also highly sensitive to moisture and are therefore unreliable under field conditions.

It is one of the objects of the present invention to overcome the disadvantages of the prior-art hit-scoring targets and to provide a target that will not produce a permanent short even after prolonged use, involving hundreds of hits, its cost per fired projectile thus being correspondingly low; that can be produced from some of the cheapest, most readily available materials, substantially reducing absolute target costs; that is insensitive to mechanical stresses caused by wind, ricochets and the like, to electrical or radio interference; that operates reliably over a wide range of temperatures, and is impervious to moisture.

This the invention achieves by providing a hit-scoring target for shooting practise comprising several mutually bonded layers, including:

a first layer at least the outside surface of which is electrically conductive;

second, electrically nonconductive, at least semi-rigid layer imparting mechanical strength to said first layer and made of a material tolerant of the heat of a freshly fired projectile;

a third, electrically nonconductive layer made of an elastically resilient material;

a fourth layer of which at least the surface contacting said third layer is electrically conductive;

a fifth layer serving as a backing and imparting relative rigidity to said target, wherein the distance between the electrically conductive surfaces of said first and said fourth layer is smaller than the length of the shortest projectile to be fired at said target, whereby a projectile hitting, penetrating and passing through said target causes a transient electrical low-resistance connection to be established between said electrically conductive surfaces.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description take with the drawings making apparent to those skilled in the art how the several forms of the invention may be embodied in practice.

Figure 2:
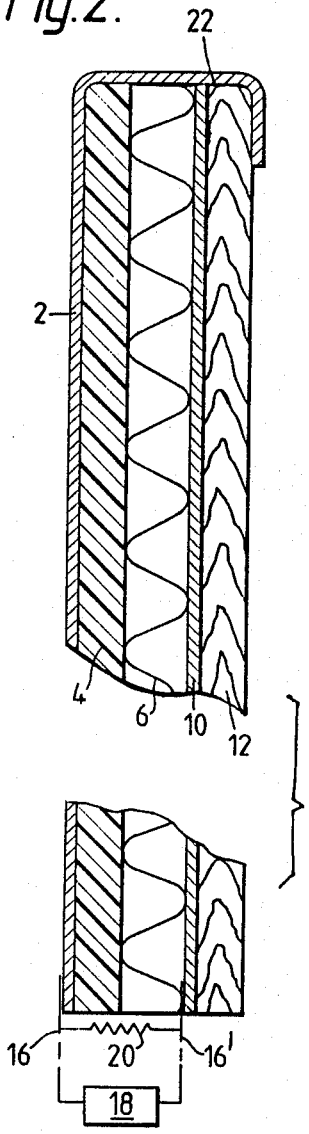

In the Figures:

FIG. 1 is a schematic partial, cross-section, view, greatly enlarged, of first embodiment of the target according to the invention, and FIG. 2 is a similar view of a second embodiment of the target.

Referring now to the drawings, there is seen in FIG. 1 a first layer 2 consisting of an aluminum foil of a thickness of, typically, 0.7–1 bonded to a paper substrate. Bonding is advantageously effected by introducing a polyethylene film between the foil and the paper sheet, and applying heat as well as pressure. In the assembled state of the target, the conductive aluminum constitutes the outside surface of first layer 2.

The second layer 4 is designed to impart mechanical strength to the thin top layer 2. In this particular embodiment, the layer 4 consists of corrugated cardboard, the corrugations of which have a relatively small pitch, which makes for added strength. It was also found that at least one liner, i.e., the flat paper web covering the corrugations, could be dispensed with, the peaks of the corrugations being directly glued to the paper substrate of the first layer 2.

The third layer 6 is intended to be elastically resilient, i.e., to push back the first and second layers 2 and 4 after penetration of a projectile, in order to prevent formation of a permanent short. This layer, too, is made of corrugated cardboard. To provide the required resilience, its corrugations have a relatively large pitch. In this embodiment, this layer has no liners, its peaks adjacent to layer 4 being glued to the existing liner 8 of layer 4. On the other side, its peaks are bonded to the conductive aluminum surface of the next, fourth, layer, being layer 10 which is identical to layer 2, consisting of an aluminum foil bounded to a paper substrate. It should be noted that in both layers 2 and 10, the conductive aluminum coat faces the oncoming projectile.

The last, fifth, layer, 12, is a backing layer and serves to impart rigidity to the assembled target and, in this embodiment, consists of corrugated cardboard with one liner only, its liner-less peaks being directly glued to the paper substrate of the fourth layer, 10.

In this embodiment, four liners have been saved, a substantial economy, further reducing the costs of this target.

Depending on the corrugated-cardboard manufacturing and gluing machinery available, it might however still be advisable, for technological reasons, to use standard corrugated-cardboard webs each having two liners.

FIG. 1 also shows a projectile 14 in the process of penetrating the target, its metal jacket temporarily shorting the two aluminum coated layers 2 and 10. By means of leads 16, 16' these layers are connected to the electronic scoring circuitry 18 which, in a per se known manner, cummulatively records a hit as soon as such a short is transiently created by a projectile.

Since the "black box" 18 may be located tens and even hundreds of meters away from the target, it is important to make sure from time to time that there is no break in the leads 16, 16' as such a break may cause a misleading "no hits" indication. Such a permanent or intermittent status check is facilitated by a high-ohmic resistor 20 connected across the leads 16, 16'. While the resistance of this resistor is too high to permit the current passing through it to trigger the scoring circuit, it is low enough to provide a positive conductance signal whenever the status circuit is addressed.

For use in humid climates and under rain, the target according to the invention can be impregnated with a water-repellant substance. An additional water-proofing measure will be discussed in conjunction with FIG. 2.

FIG. 2 schematically illustrates a second embodiment of the target according to the invention. In this embodiment, the second layer 4 which, in the embodiment of FIG. 1 consisted of corrugated cardboard, is now made of a semi-rigid plastic, the softening temperature of which must obviously be above the jacket temperature of a freshly fired projectile. The backing layer 12 is also no longer made of corrugated cardboard, consisting now of plywood, fiberboard or the like.

Waterproofing is enhanced by providing the first layer 2 with an edge margin portion 22 which, as can be seen in the upper part of FIG. 2, is folded over, and thereby fully covering, the vulnerable edge of the target, preferably all around the target, but at least at its upper portion.

While in FIGS. 1 and 2 the resistor 20 is shown as located outside the target proper, it is advantageously embedded inside the target, close to the lower edge, where it is least likely to be damaged by a hit.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A hit-scoring target for shooting practice comprising several mutually bonded layers, including a first layer at least the outside surface of which is electrically conductive, a second, electrically non-conductive, at least semi-rigid layer imparting mechanical strength to said first layer and made of a material tolerant of the heat of a freshly fired projectile, a third, electrically non-conductive layer made of an elastically resilient material, a fourth layer of which at least the surface contacting said third layer is electrically conductive, a fifth layer serving as a backing and imparting relative rigidity to said target, wherein the distance between the electrically conductive surfaces of said first and said fourth layer is smaller than the length of the shortest projectile to be fired at said target, whereby a projectile hitting, penetrating and passing through said target causes a transient electrical low-resistance connection to be established between said electrically conductive surfaces, said second layer comprises corrugated cardboard the corrugations of which have a relatively small pitch, and at least one face of said second layer is liner-less, said first layer includes a paper substrate having said electrically conductive outside surface thereon, and the peaks of the corrugations of said second layer are directly bonded to the paper substrate of said first layer.

2. A hit-scoring target for shooting practice comprising several mutually bonded layers, including a first layer at least the outside surface of which is electrically conductive, a second, electrically non-conductive, at least semi-rigid layer imparting mechanical strength to said first layer and made of a material tolerant of the heat of a freshly fired projectile, a third, electrically non-conductive layer made of an elastically resilient material, a fourth layer of which at least the surface contacting said third layer is electrically conductive, a fifth layer serving as a backing and imparting relative rigidity to said target, wherein the distance between the electrically conductive surfaces of said first and said fourth layer is smaller than the length of the shortest projectile to be fired at said target, whereby a projectile hitting, penetrating and passing through said target causes a transient electrical low-resistance connection to be established between said electrically conductive surfaces, said third layer comprises corruganted cardboard, at least one face of said third layer comprising said corrugated cardboard being liner-less, and the peaks of the corrugations of said third layer are directly bonded to the electrically conductive surface of said fourth layer.

3. A hit-scoring target for shooting practice comprising several mutually bonded layers, including a first layer at least the outside surface of which is electrically conductive, a second electrically non-conductive, at least semi-rigid layer imparting mechanical strength to said first layer and made of a material tolerant of the heat of a freshly fired projectile;

a third, electrically nonconductive layer made of an elastically resilient material, a fourth layer of which at least the surface contacting said third layer is electrically conductive, and a fifth layer serving as a backing and imparting relative rigidity to said target, wherein said second layer consists of corrugated cardboard, at least one face of said second layer being liner-less, the corrugations thereof being directly bonded to said first layer, and wherein the distance between the electrically conductive surfaces of the first and said fourth layer is smaller than the length of the shortest projectile to be fired at said target, whereby a projectile hitting, penetrating and passing through said target causes a transient electrical low-resistance connection to be established between said electrically conductive surfaces.

4. A hit-scoring target for shooting practice comprising several mutually bonded layers, including a first layer at least the outside surface of which is electrically conductive, a second, electrically non-conductive, at least semi-rigid layer imparting mechanical strength to said first layer and made of a material tolerant of the heat of a freshly fired projectile, a third, electrically non-conductive layer made of an elastically resilient material, a fourth layer of which at least the surface contacting said third layer is electrically conductive, a fifth layer serving as a backing and imparting relative rigidity to said target, wherein said third layer consists of corrugated cardboard, at least one face of said third layer being liner-less, the corrugations thereof being directly bonded to the electrically conductive surface of said fourth layer, and the distance between the electrically conductive surfaces of the first and said fourth layer is smaller than the length of the shortest projectile to be fired at said target, whereby a projectile hitting, penetrating and passing through said target causes a transient electrical low-resistance connection to be established between said electrically conductive surfaces.

5. A hit-scoring target for shooting practice comprising several mutually bonded layers, including a first layer at least the outside surface of which is electrically conductive, said first layer providing a moisture barrier, a second, electrically non-conductive, at least semi-rigid layer imparting mechanical strenght to said first layer and made of a material tolerant of the heat of a freshly fired projectile, a third, electrically non-conductive layer made of an elastically resilient material, a fourth layer of which at least the surface contacting said third layer is electrically conductive, and a fifth layer serving as a backing and imparting relative rigidity to said target, wherein a margin portion of said first layer is folded over at least the upper portion of the edge of said target to protect said target from water, said target is impregnated with a water-repellant substance, and the distance between the electrically conductive surfaces the first and said fourth layer is smaller than the length of the shortest projectile to be fired at said target, whereby a projectile hitting, penetrating and passing through said target causes a transient electrical low-resistance connection to be established between said electrically conductive surfaces.

6. The target claimed in claim 3, 4 or 5, wherein said first and said fourth layers each consist of a respective aluminum foil bonded to a respective paper substrate.

7. The target as claimed in claim 3, wherein said corrugations of said second layer have a relatively small pitch.

8. The target as claimed in claim 4, wherein said corrugations have a relatively large pitch.

9. The target of claim 5, wherein said folded-over margin portion of said first layer is folded over at least an upper portion of each said second, third, fourth and fifth layers and onto an adjacent back portion of said fifth layer, to provide said waterproofing of inner layers of said target, said inner layers comprising said second, third and fourth layers.

10. A hit-scoring target for shooting practice comprising several mutually bonded layers, including a first layer at least the outside surface of which is electrically conductive, said first layer providing a moisture barrier, a second, electrically non-conductive, at least semi-rigid layer imparting mechanical strength to said first layer and made of a material tolerant of the heat of a freshly fired projectile, a third, electrically non-conducting layer made of an elastically resilient material, a fourth layer of which at least the surface contacting said third layer is electrically conductive, and a fifth layer serving as a backing and imparting relative rigidity to said target, wherein a margin portion of said first layer is folded over at least the upper portion of the edge of said target to protect said target from water, the distance between the electrically conductive surfaces of the first and said fourth layer is smaller than the length of the shortest projectile to be fired at said target, and said first layer comprising a metal foil for providing said electrically conductive outside surface of said first layer, and said moisture barrier arising as a result of said metal foil, whereby a projectile hitting, penetrating and passing through said target causes a transient electrical low-resistance connection to be established between said electrically conductive surfaces.

11. A hit-scoring target for shooting practice comprising several mutually bonded layers, including a first layer at least the outside surface of which is electrically conductive, said first layer providing a moisture barrier, a second, electrically non-conductive. at least semi-rigid layer imparting mechanical strength to said first layer and made of a material tolerant of the heat of a freshly fired projectile, a third, electrically non-conducting layer made of an elastically resilient material, a fourth layer of which at least the surface contacting said third layer is electrically conductive, and a fifth layer serving as a backing and imparting relative rigidity to said target, wherein, to protect said target from water, a margin portion of said first layer is folded over the edge of said target all around said target, and the distance between the electrically conductive surfaces of said first and said fourth layers is smaller than the length of the shortest projectile to be fired at said target whereby a projectile hitting, penetrating and passing through said target causes a transient electrical low-resistance connection to be established between said electrically conductive surfaces.

12. A hit-scoring target for shooting practice comprising several mutually bonded layers, including:

a first layer at least the outside surface of which is electrically conductive;

a second, electrically nonconductive, at least semi-rigid layer imparting mechanical strength to said first layer and made of a material tolerant of the heat of a freshly fired projectile;

a third, electrically nonconductive layer made of an elastically resilient material;

a fourth layer of which at least the surface contacting said third layer is electrically conductive;

a fifth layer serving as a backing and imparting relative rigidity to said target, wherein said first layer provides a moisture barrier, a margin portion of said first layer being folded over at least the upper portion of the edge of said target to protect said target from water, and wherein said first and said fourth layer each consist of an aluminum foil bonded to a paper substrate, and wherein the distance between the electrically conductive surfaces of the first and said fourth layer is smaller than the length of the shortest projectile to be fired at said target, whereby a projectile hitting, penetrating and passing through said target causes a transient electrical low-resistance connection to be established between said electrically conductive surfaces.

13. The target as claimed in claim 3, wherein said target is impregnated with a water-repellant substance.

14. The target as claimed in claim 4, wherein said target is impregnated with a water-repellant substance.

15. The target as claimed in claim 12, wherein said target is impregnated with a water-repellant substance.

16. The target as claimed in claim 11, wherein said target is impregnated with a water-repellant substance.

* * * * *